United States Patent [19]

Ellefson et al.

[11] 4,164,180

[45] Aug. 14, 1979

[54] IMPACT PRINTER INCLUDING HAMMER BANK ASSEMBLY

[75] Inventors: Larry P. Ellefson, Seattle; Robert J. Brooks, Woodinville; Kenneth G. Real, Redmond; John A. Manthey, Kirkland, all of Wash.

[73] Assignee: Interface Mechanisms, Inc., Mountlake Terrace, Wash.

[21] Appl. No.: 837,829

[22] Filed: Sep. 29, 1977

[51] Int. Cl.[2] ..... B41J 9/30

[52] U.S. Cl. ..... 101/93.34; 101/93.48

[58] Field of Search ..... 101/93.02, 93.29–93.34, 101/93.48; 197/53

[56] References Cited

U.S. PATENT DOCUMENTS

| | | | |
|---|---|---|---|
| Re. 27,175 | 9/1971 | Arnold et al. | 101/93.02 X |
| 3,282,203 | 11/1966 | Kalbach | 101/93.33 |
| 3,349,696 | 10/1967 | Potter | 101/93.33 |
| 3,605,611 | 9/1971 | Konkel et al. | 101/93.33 |
| 3,643,595 | 2/1972 | Helms et al. | 101/93.34 |
| 3,780,650 | 12/1973 | Meier | 101/93.48 |
| 3,941,052 | 3/1976 | Dalziel | 101/93.02 |

*Primary Examiner*—Edward M. Coven

*Attorney, Agent, or Firm*—Christensen, O'Connor, Johnson & Kindness

[57] ABSTRACT

An improved hammer bank assembly includes a plurality of spaced-apart hammers, each of the hammers including a substantially planar hammer body containing an electrical coil, with each hammer body being supported for movement in a predetermined plane. A hammer head is attached to and coplanar with each hammer body. Also included are a plurality of flat permanent magnets interleaved with the plurality of hammers so that adjacent ones of the permanent magnets oppose but are separated from each hammer body. A plurality of hammer guide members are provided, one for each hammer, with each hammer guide member defining therein an elongated groove in which is received at least a portion of each hammer head. The dimensions of each groove in a direction transverse to the predetermined plane of hammer movement, are such that the hammer head contacts the hammer support member upon deflection of the hammer in directions transverse to its predetermined plane of movement before its associated body contacts either of the adjacent, opposing permanent magnets to prevent damage to the coil within the hammer body.

10 Claims, 6 Drawing Figures

IMPACT PRINTER INCLUDING HAMMER BANK ASSEMBLY

FIELD OF THE INVENTION

This invention generally relates to mechanical impact printers, and, more particularly, to hammer bank assemblies forming part of such impact printers.

BACKGROUND OF THE INVENTION

Mechanical impact printers are known to the prior art for imprinting a succession of characters on a succession of labels which removably adhere to an elongated strip of label stock backing. In such printers, the elongated strip is moved under tension along a predetermined path, determined in part by a plurality of print stock guides, and past a print station where the characters are successively imprinted. The print station may include a continuously rotating, cylindrical print wheel having located on a circumferential surface thereof a plurality of raised elements representing the characters to be imprinted, and a hammer mechanism including at least one hammer which has a selectively controllable, pivotal movement in a predetermined plane, whereby the hammer during its travel impacts the elongated strip and an interposed ink ribbon against one of the elements of the print wheel, resulting in imprinting of a single character.

In applications wherein it is desired to imprint a plurality of spaced-apart rows of characters on each label, the print wheel has a corresponding plurality of rows of raised elements on its circumferential surface. The hammer mechanism comprises a hammer bank assembly having a plurality of hammers, one for each character row to be imprinted. An example of such a hammer bank assembly known to the prior art is that taught in U.S. Pat. No. 3,983,806, Ishii, issued Oct. 5, 1976. In hammer bank assemblies of this type, each hammer includes a flat body containing an electrical coil. Secured to one end of the body is a head, typically composed of a plastic material, which contains a planar face for impacting a print stock. Secured to the other end of the body is a base, also typically of plastic material, from which extends a pair of electrically-conductive spring members interconnected with respective ends of the electrical coil. The spring members are in turn received in a support which secures the hammer to a mounting structure. First and second magnet assemblies are supported by the mounting structure in proximity to opposing sides of the body. Application of an electrical signal via the spring members to the coil within the body causes the generation of a magnetic flux which interacts with that produced by the first and second magnet assemblies so that the hammer pivots on the spring members to undergo a planar movement to and from the print stock.

When hammer bank assemblies of this type are installed in impact printers of the type described above, the individual hammers experience a very high failure rate in actual use which necessitates frequent hammer replacement and a consequent loss in productivity of the impact printer.

It is therefore an object of this invention to provide an improved hammer bank assembly for impact printers which imprint a plurality of spaced-apart character rows on an elongated strip of print stock.

It is another object of this invention to provide such an improved hammer bank assembly in which the individual hammers have a much lower failure rate than the hammers used in the hammer bank assemblies of the prior art.

An improvement is provided in a hammer bank assembly including a plurality of spaced-apart, parallel hammers, each of the hammers including a substantially planar, hammer body containing an electrical coil, with each hammer body being supported for movement in a predetermined plane, and with the hammer head being attached to and coplanar with each hammer body. The hammer bank assembly further includes a plurality of flat permanent magnets interleaved with a plurality of hammers so that adjacent ones of the permanent magnets oppose but are separated from each hammer body, whereby each of the hammers is caused to move in a predetermined plane upon application of an electrical signal to the electrical coil within the corresponding hammer body and a resultant magnetic interaction with the adjacent permanent magnets. The improvement is particularly directed to hammer guide means for preventing damage to the electrical coils, the hammer guide means being located in proximity to the hammer heads for limiting deflection of each hammer in a direction transverse to the predetermined plane of hammer movement to a predetermined amount less than that which would result in each hammer body contacting either of the adjacent permanent magnets.

In a preferred embodiment, the function of the hammer guide means is provided by a plurality of hammer guide members each defining therein an elongated, substantially rectangular groove. Each of the hammer heads is provided with a substantially rectangular, elongated portion, and each of the grooves is configured so as to be complementary to the elongated portion of each hammer head. The hammer guide members are secured in a spaced-apart manner so that the elongated portion of the head of each of the plurality of hammers is received in a corresponding one of the grooves, the dimension of each groove in a direction transverse to the predetermined plane of hammer movement being larger than a corresponding dimension of the elongated portion but small enough so that the elongated portion contacts the hammer support member upon deflection of the hammer in directions transverse to its predetermined plane of movement before the associated hammer body contacts either of the adjacent permanent magnets.

DESCRIPTION OF THE DRAWINGS

The invention can best be understood by reference to the following portion of the specification, taken in conjunction with the accompanying drawings in which.

DESCRIPTION OF A PREFERRED EMBODIMENT

Figure 1:
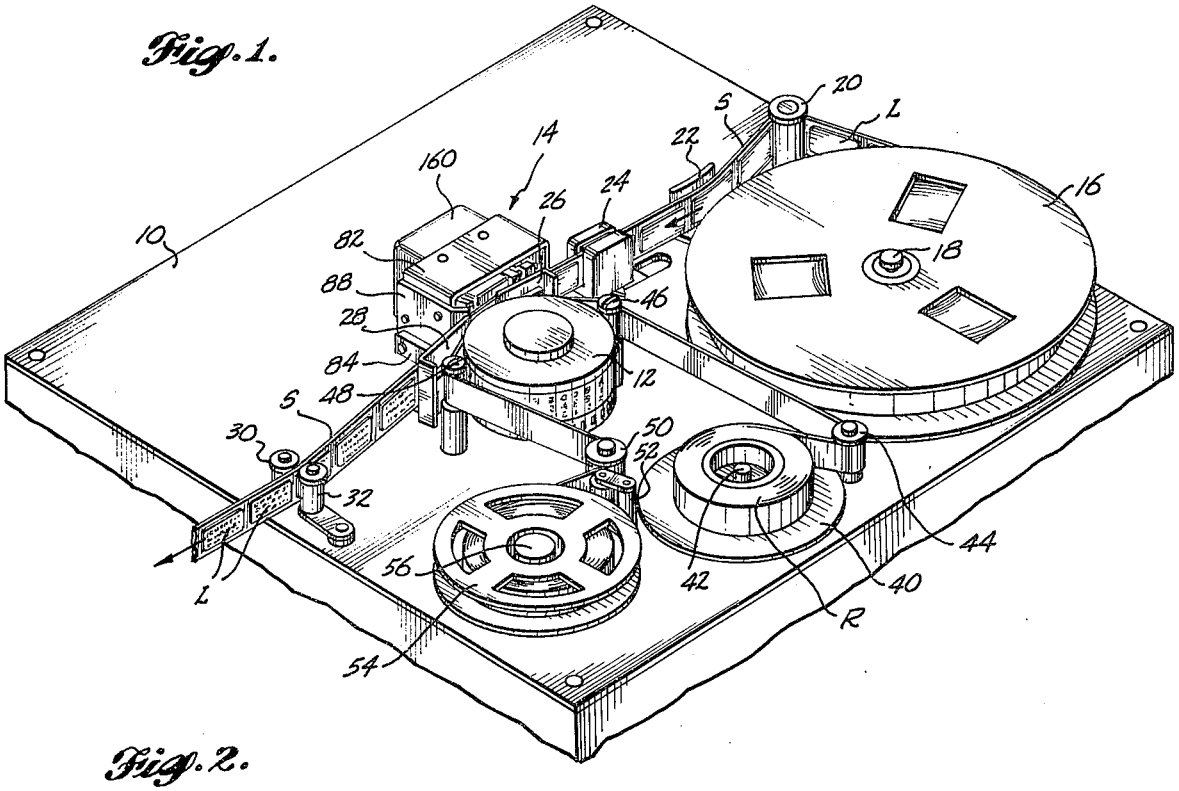
FIG. 1 is a pictorial view of an impact printer including the improved hammer bank assembly of the present invention.

Referring now to FIG. 1, the impact printer includes a base plate 10 above which a print wheel 12 is supported for rotation. The circumferential surface of print wheel 12 has located thereon a plurality of raised character elements representing the characters to be imprinted, with the raised character elements being grouped in a plurality of vertically spaced-apart rows corresponding to the character rows to be imprinted. The print wheel 12 is continuously rotated about a central axis by a drive means, which is supported on a subplate located below base plate 10 (the subplate and drive means are not illustrated). A hammer bank assembly 14 is located in proximity to the print wheel 12 and together with the print wheel 12 forms a print station. As will be explained in more detail hereinafter, the hammer bank assembly 14 includes a plurality of vertically spaced-apart hammers, one for each character row to be imprinted. Each hammer is capable of a controllable, pivotal movement whereby a hammer face thereof impacts a back surface of an elongated strip of label stock backing S to press one of a plurality of labels L, removably adhering to a front surface of the backing S, and an interposed ink ribbon R against one of the raised elements in the corresponding row on print wheel 12 to thereby imprint a character on the label L.

The print stock including the label stock backing S is obtained from a print stock supply reel 16 which is rotatably supported on a shaft 18 mounted on a subplate (not illustrated) below base plate 10. From the print stock supply reel 16, the print stock is first drawn around a supply tension roller 20 supported on a lever arm (not illustrated) which is mounted on base plate 10 and from there moves in a predetermined path past a guide member 22, a print stock sensor 24, and a guide member 26 to the print station. Immediately after leaving the print station, the print stock moves in a predetermined path as it is drawn over a guide member 28 and pressed against a drive capstan 30 by an associated pinch roller 32, and then exits from the impact printer. The drive capstan 30 is rotated by a drive capstan motor, not illustrated, mounted below the base plate 10. During its passage through the impact printer from the supply reel 16 to the drive capstan 30, the print stock is maintained under tension by the tension roller 20 acting against the force exerted on the print stock by the drive capstan 30.

The ink ribbon R is obtained from a ribbon supply reel 40 which is rotatable on a shaft 42 mounted on base plate 10. From the ribbon supply reel 40, the ink ribbon R passes around a supply tension roller 44, supported on a lever arm (not illustrated) which is mounted on base plate 10, and around a guide pin 46 and through the print station and to a guide pin 48, with guide pin 46 and guide pin 48 being mounted on base plate 10. From guide pin 48, the ink ribbon R passes around a drive capstan 50 which is rotated by a drive capstan motor, not illustrated, and is pressed against drive capstan 50 by a pinch roller 52 mounted on base plate 10. From drive capstan 50, the ink ribbon R is taken up on a ribbon take-up reel 54 which is rotatable with the shaft 56 of a ribbon driver motor, not illustrated.

As is conventional in the prior art, electronic control means is provided for controlling and coordinating the rotation of drive capstans 30, 50 to provide movement of the print stock and the ink ribbon past the print station. Electronic control means is likewise provided for coordinating the movement of the hammers within the hammer bank assembly 14 with the rotation of print wheel 12 under control of timing signals obtained from print wheel 12 to provide imprinting of selected characters in succession in a plurality of rows on the labels L removably adherent to the label stock backing S.

Figure 2:
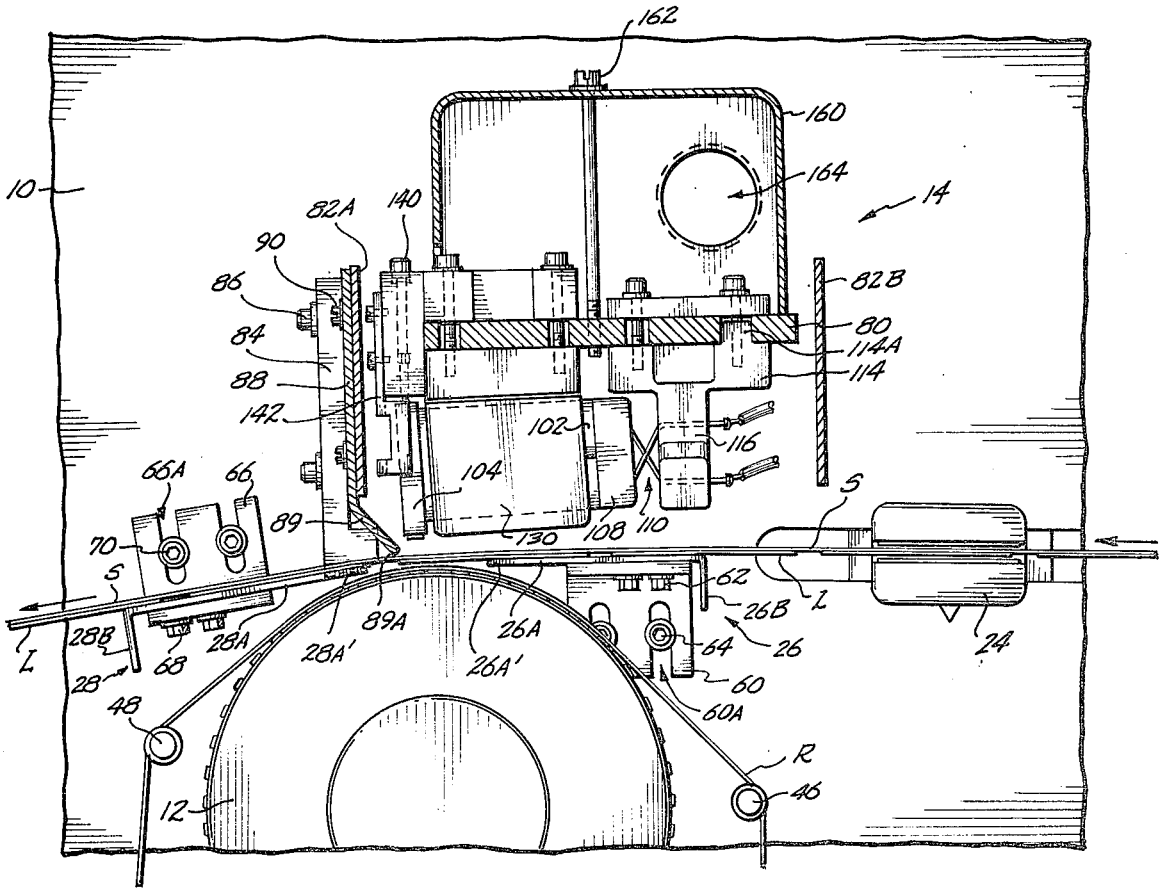
FIG. 2 is a partially cut-away, top plan view of the improved hammer bank assembly as installed in proximity to a continuously rotating print wheel of the impact printer.
Figure 3:
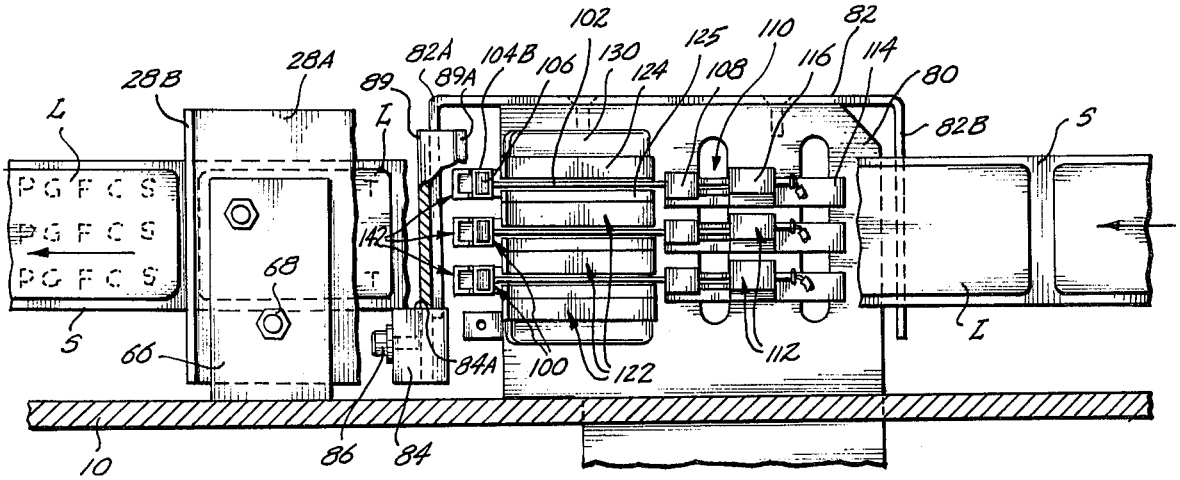
FIG.3 is a partially cut-away, front elevational view of the improved hammer bank assembly.

Referring now to FIGS. 2–3, the print stock comprising the elongated strip of label stock backing S exits from the print stock sensor 24 so that the print stock is in a supply position for the print station. The print stock then moves in a predetermined path through the print station by passing over the guide member 26, through the print station wherein the label stock backing S is in close proximity to the print wheel 12 (with the labels L and ink ribbon R being interposed between the label stock backing S and the print wheel 12), and then over the guide member 28 to a take-up position from which it exits to the drive capstan 30.

Figure 4:
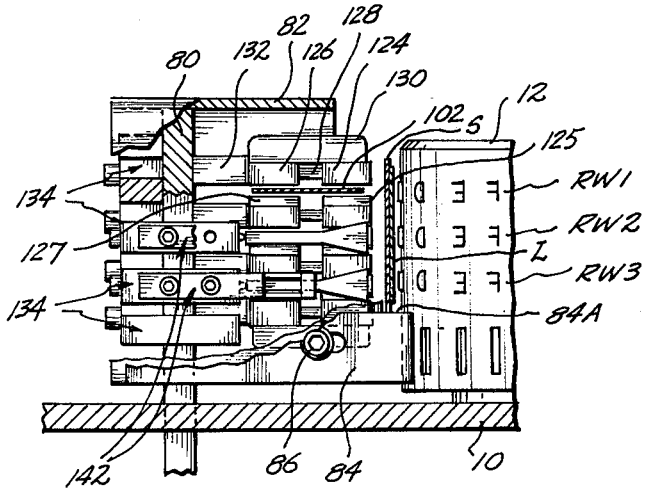
FIG. 4 is a partially cut-away, side elevational view of the improved hammer bank assembly in proximity to the print wheel.

As can be seen particularly in FIG. 4, print wheel 12 comprises a right cylinder with, in this embodiment, three vertically-spaced rows RW1, RW2 and RW3 of raised elements on the circumferential surface thereof. As presented to the print station during revolution of the print wheel 12, individual, vertically aligned elements in the rows RW1, RW2 and RW3 lie in a common plane which is defined by a first line parallel to the axis of print wheel 12 and a second line orthogonally intersecting the first line. It is necessary to maintain the print stock in a plane which is parallel to this common plane as the print stock passes through the print station so that the characters in each of the three rows corresponding to rows RW1, RW2 and RW3 are imprinted equally on the labels L. To this end, the guide member 26 is substantially L-shaped, having an elongated, first leg 26A providing a first planar guide surface (that facing the print stock) and an integral, second leg 26B. Leg 26A is secured to an angle bracket 60 by a pair of fasteners 62, with angle bracket 60 in turn being adjustably secured to base plate 10 by a pair of fasteners 64 which pass through corresponding slots 60A in angle bracket 60. Angle bracket 60 supports guide member 26 so that the planar guide surface of leg 26A thereof lies in a first plane parallel to the first line in the common plane of the elements on print wheel 12, and substantially parallel to the second line in that common plane. Similarly, the guide member 28 is substantially L-shaped and includes an elongated, first leg 28A having a planar guide surface (that facing the print stock) and an integral, second leg 28B. Leg 28A is secured to an angle bracket 66 by a pair of fasteners 68, with angle bracket 66 being adjustably secured to the base plate 10 by a pair of fasteners 70 passing through corresponding slots 66A. Angle bracket 66 supports guide member 28 so that the planar guide surface of leg 28A thereof lies in a second plane which is parallel to the first line in the common plane of the elements on print wheel 12 and which extends at an angle with respect to the second line in that common plane.

Due to the positioning of the guide member 22 and drive capstan 30 (FIG. 1), the front surface of the label stock backing S having the labels L adherent thereto is pressed against the planar guide surfaces afforded by legs 26A and 28A of guide members 26 and 28, respectively. It will be noted from a careful consideration of FIGS. 2 and 3 that the guide members 26 and 28 are formed from thin, plate-like material, with the legs 26A, 28A thereof being rigidified by securement to the angle brackets 60, 66, respectively, and by their respective, integral legs 26B, 28B. It will also be noted that each guide member 26, 28 is thinner, in a direction transverse to the direction of elongation thereof, at its end facing the print station (ends 26A', 28A') than at its end away from the print station (adjacent legs 26B, 28B) so that ends 26A', 28A' can be brought into close proximity to the points of impact of the hammer heads (denoted 104) with the raised elements on the circumferential surface of the print wheel 12. By arranging the planar guide surfaces of guide members 26 and 28 as previously described so that those planar guide surfaces lie in first and second planes which are parallel to the first line in common plane of the elements on print wheel 12, the print stock including the label stock backing S and the plurality of labels L will be seen to also lie in a plane which is parallel to that common plane as the print stock passes through the print station, and, more particularly, past the points of impact of the hamamer heads 104 with the print wheel 12.

The print stock while in the print station must also be separated from the common plane of the elements on print wheel 12 in a direction normal to that common plane by an amount sufficient to provide optimum print quality. If the print stock is too close to that common plane, then adjacent character imprinting or "shadowing" may occur during the imprinting of a character in any of the rows corresponding to the rows RW1, RW2 and RW3. On the other hand, if the the print stock is maintained too far from that common plane, then excess energy will be required to cause the hammer heads 104 to drive the print stock toward the print wheel 12, with a consequent loss in print quality. Providing the guide members 26, 28 with the thin legs 26A, 28A allows the ends 26A', 28A' to be brought into close proximity with the print station so that the separation between the the print stock and the common plane of the elements on the print wheel 12 can be precisely determined. Since the end 28A' of leg 28A lies closer to the points of impact of the hammer heads 104 with the print wheel 12 than does the end 26A' of leg 26A (as best seen in FIG. 2), it will be appreciated that adjustment of the position of leg 28A with respect to the base plate 10 (by loosening the fastener 70 and sliding the angle bracket 66 with respect thereto) provides a coarser adjustment in the separation between the print stock and the common plane of the elements on print wheel 12 than does adjustment of the position of leg 26A on base plate 10 (again, by loosening fasteners 64 and sliding the angle bracket 60 with respect thereto).

During imprinting, the print stock must be maintained at the same vertical position with respect to the rows RW1, RW2 and RW3 as the label stock backing S is drawn through the print station so that successive characters on the labels L are not misaligned. Also, it is desirable to substantially reduce or eliminate smudging of the imprinted characters. To these ends, the hammer bank assembly 14 includes an assembly support member comprising a support plate 80 which is rigidly secured to the portion of the impact printer below the base plate 10, not illustrated in the drawings, and which extends above base plate 10 in assembly. All of the remaining structure of the hammer bank assembly 14, including the hammers for the three rows RW1, RW2 and RW3, is attached to the support plate 80, as will be hereinafter described. In addition, a substantially U-shaped cover 82 is affixed to the top of the support plate 80, with cover 82 having downwardly-depending legs 82A, 82B. In assembly, leg 82A is disposed in proximity to print wheel 12. A reference guide member 84 is affixed to leg 82A by a pair of fasteners 86, with one end of reference guide member 84 projecting into the path of travel of the print stock through the print station. As best illustrated in FIGS. 3 and 4, reference guide member 84 is provided with a substantially planar, upper reference guide surface 84A which lies in a plane perpendicular to the common plane of the elements on the print wheel 12. As the label stock backing S passes through the print station, the lower edge surface thereof rests on the surface 84A so that the labels L are always maintained at the same vertical position with respect to the rows RW1, RW2 and RW3.

A guide member 88 is also affixed to the leg 82A of the cover 82 by a pair of fasteners 90. The guide member 88 includes a dog leg portion 89 which projects toward the print station and which has a substantially planar tip surface 89A which extends parallel to the first line in the common plane of the elements on print wheel 12. It has been found in practice that the cause of smudging of the imprinted characters results from movement of the label stock backing S toward the hammer bank assembly 14 after imprinting, and resultant oscillation of the label stock backing S between the hammer bank assembly 14 and the print wheel 12 so that the labels L again contact the ink ribbon R. Accordingly, the tip 89A is positioned to lie in proximity to the back surface of the label stock backing S as the print stock lies in its predetermined path through the print station so as to engage the back surface as the print stock moves from its predetermined path by an amount less than the separation of the print stock from the common plane of elements on print wheel 12. The label stock backing S can therefore move only a predetermined amount toward the hammer bank assembly 14 after imprinting so that the resultant oscillation thereof is limited to an amount which will not result in the labels L again contacting the ink ribbon R.

As best seen in FIG. 3, the planar guide surfaces of guide members 26 and 28, and the tip 89A of guide member 88, preferably extend above the reference guide surface 84A in a direction parallel to the first line in the common plane of elements on print wheel 12 by amounts greater than the dimension of the label stock backing S between its lower and upper edge surfaces.

Figure 5:
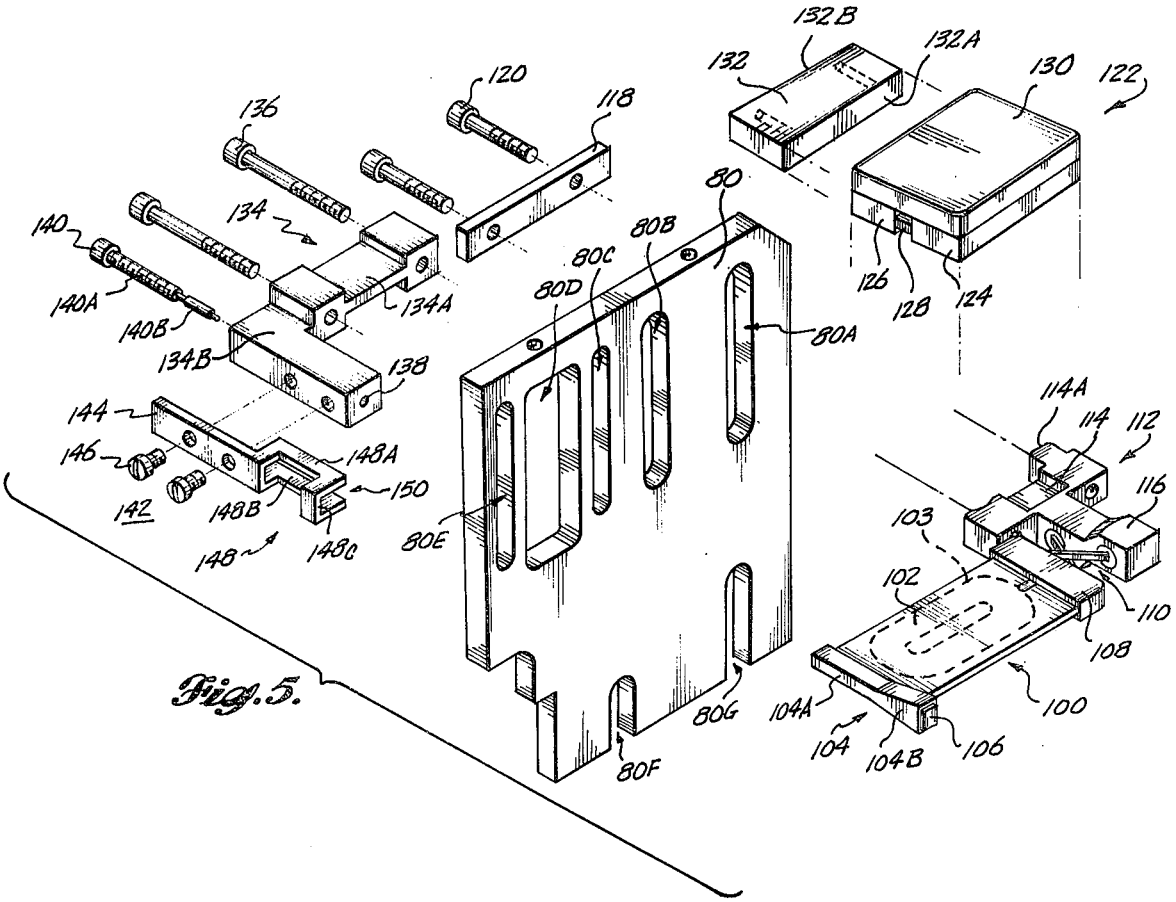
FIG. 5 is an exploded, pictorial view of a portion of the improved hammer bank assembly; and, FIG. 6 is a magnified portion of the top plan view in FIG. 2.
Figure 6:
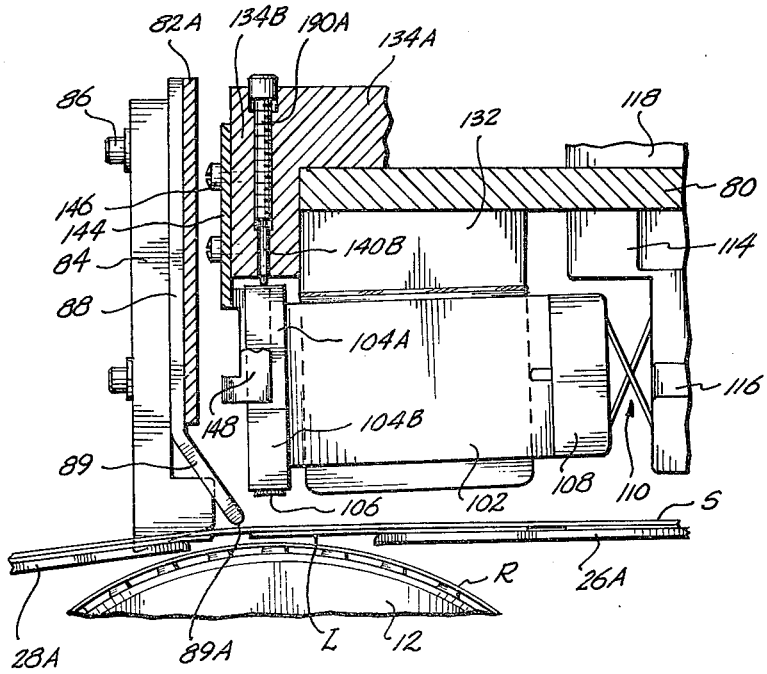

With additional reference now to FIGS. 5 and 6, the hammer bank assembly 14 includes a plurality of hammer modules 100, one for each row RW1, RW2, and RW3. Each hammer module 100 includes a body 102 comprising a flat plate, of nonmagnetic material, which contains an electrical coil 103. Attached to one end of the body 102 and coplanar with body 102 is a hammer head 104, preferably of plastic material such as polycarbonate, which is divided into a first portion 104A, of substantially rectangular configuration, and a second portion 104B, which tapers outwardly from the first portion 104A. Contained within the second portion 104B is a metallic member which has a substantially planar face 106 exposed at one end of the second portion 104B. Attached to the other end of the body 102 is a base 108, preferably of plastic material, which contains and from which extends a pair of electrically-conductive spring members 110. Within base 108, each of the spring members 110 is connected to one end of the electrical coil 103 within body 102. A T-shaped hammer support member 112 is provided for each hammer module 100, with the support member 112 including a head 114 and an integral, dependent leg 116. The spring members 110 cross each other as they extend from the base 108 and are received in corresponding, spaced-apart apertures in leg 116 and secured thereto by an appropriate material such as an epoxy resin. It will therefore be appreciated that each hammer module 100 is free to pivot in a predetermined plane on its associated pair of spring members 110 with respect to its associated support member 112.

As best seen in FIG. 3, the hammer modules 100 are vertically spaced in assembly, with the support members 112 being secured to the support plate 80. In particular, a projection 114A from the head 114 of each support member 112 is received in a corresponding, vertically-extending slot 80A in the support plate 80 so that each head 114 abuts one side of the support plate 80. Preferably, the horizontal dimensions of the slot 80A are slightly greater than the horizontal dimensions of each projection 114A. Each support member 112 is rigidly secured to the support plate 80 by the use of a corresponding bar 118, with each bar 118 being located on the other side of support plate 80 and with a pair of fasteners 120 passing through a corresponding pair of apertures in each bar 118, through the slot 80A and an adjoining, vertically-extending slot 80B, and being received in a corresponding pair of threaded apertures in the associated head 114. When the pair of fasteners 120 are loosened, the support members 112 may be vertically moved, with the projections 114A thereof riding in the vertically-extending slot 80A, until the hammer faces 106 are aligned with the corresponding rows RW1, RW2 and RW3 on the print wheel 12. Each of the support members 112 may also be slightly moved horizontally so that the hammer faces 106 can be vertically aligned with each other. After alignment is complete, the pair of fasteners 120 are tightened to compress the support plate between the hammer support member 112 and its corresponding bar 118.

Electrical connections are made between each pair of spring members 110 and a source of selectively-controllable electrical pulses, not illustrated. In order to develop a propelling force on each hammer module 100 as an electrical pulse is provided to the associated coil 103 within the body 102 thereof, a plurality of magnet modules 122 are provided, with the magnet modules 122 being vertically spaced in assembly with the support plate 80 to define a plurality of air gaps in which are located the bodies 102 of the hammer modules 100. Each magnet module 122 includes a first, flat permanent magnet 124 and a second, flat permanent magnet 126, with permanent magnets 124 and 126 being joined together by an intermediate member 128 of nonmagnetic material. The outer two of the magnet modules 122 are also each provided with a plate 130 of magnetic material which functions as a magnetic keeper to provide a concentrated return path for the magnetic flux generated by the magnet modules 122. Certain ones of the magnet modules 122 are also provided with a pair of shims 125, 127, respectively secured to the permanent magnets 124, 126 so as to aid in precisely defining the dimensions of the air gaps between adjacent ones of the magnet modules 122.

Each magnet module 122 also includes a block 132, of nonmagnetic material, having a planar front surface 132A and a planar rear surface 132B, with front surface 132A being slightly inclined from a plane parallel to rear surface 132B by an angle of a few degrees, e.g., 4°, to optimize the propelling force on each hammer module 100. The permanent magnet 126 in each magnet module 122 is secured to the front surface 132A by the use of an appropriate adhesive material. Each block 132 is assembled with the support plate 80 so that the rear surface 132B abuts one side of the support plate 80, and is rigidly secured to support plate 80 by the use of a corresponding L-shaped member 134. A first leg 134A of each L-shaped member 134 is disposed on the other side of support plate 80, with a pair of fasteners 136 passing through a corresponding pair of apertures in the first leg 134A, through respective vertically-extending, spaced-apart slots 80C, 80E in support plate 80, and being received in a corresponding pair of threaded apertures in the associated block 132. In this manner, the vertical position of each magnet module 122 can be individually adjusted as the associated pair of fasteners 136 are loosened so that the air gaps between adjacent magnet modules 122 may be precisely determined.

In order to insure that the hammer face 106 of each hammer module 100 develops the same imprinting force, it is desirable that the rest position of each hammer module 100 be individually adjusted. Accordingly, each L-shaped member 134 includes a second leg 134B which extends around the support plate 80 in proximity to the associated hammer head 104. Each leg 134B is offset from its leg 134A so that each leg 134B lies substantially in the plane of movement of its associated hammer module 100 in assembly. A threaded aperture 138 extends through each leg 134B and receives a stop screw 140 having a threaded shank 140A and an adjoining tip 140B. In assembly, the tip 140B projects from its associated leg 134B and abuts a rear surface of the first portion 104A of the associated hammer head 104. Rotation of the stop screw 140 accordingly determines the rest portion of the associated hammer module 100. Preferably, each stop screw 140 is formed from a plastic material such as polyurethane. The plastic materials of the head 104 and of the stop screw 140 therefore function to dampen the motion of the associated hammer 100 as the hammer returns to its rest position after imprinting.

As previously mentioned, hammers of the type described experience a very high failure rate when used in impact printers of the type described. It has been discovered that hammer failure can be attributed primarily to breakage or damage of the electrical coil 103 contained within each body 102, and that such coil breakage or damage is caused by contact of the body 102 with either or both of the permanent magnets in the adjacent magnet modules 122 upon return of the hammer module 100 to its rest position after imprinting. As the hammer module 100 is propelled toward the print wheel 12, it moves in a predetermined plane such that the body 102 does not contact either of the adjoining magnet modules 122. However, the impact forces generated during imprinting oftentimes impart a very slight sideways motion to the hammer module 100, with the result that the body 102 contacts either or both of the adjoining magnet modules 122 as the hammer module 100 returns to its rest position. Theoretically, this problem could be solved by increasing the air gap between adjacent magnet modules 122. However, in practice, such a solution is not practicable, inasmuch as a certain flux density must be maintained across the air gap in order to achieve proper hammer actuation. Accordingly, the present invention provides a means for preventing the body 102 from coming into contact with either of the adjoining magnet modules 122 upon hammer return.

Specifically, a hammer guide 142 of nonmagnetic material, preferably anodized aluminum, is provided for each hammer module 100. Each hammer guide 142 includes a flat portion 144 which is secured to the corresponding leg 134B of the associated L-shaped member 134 by a pair of fasteners 146. Integral with the first portion 144 and extending toward the print wheel 12 in assembly is a U-shaped portion 148 which includes first and second legs 148A, 148B depending from an interconnecting bridge 148C so that opposing, inner surfaces of the legs 148A, 148B define a longitudinally-extending groove 150. In assembly, as best seen in FIG. 4, each U-shaped portion 148 overlies one of the hammer heads 104, with the first portion 104A thereof being received in the corresponding groove 150 and with the opposing surfaces of legs 148A, 148B lying in planes parallel to but separated from the predetermined plane of hammer movement. The opposing surfaces of the legs 148A, 148B are separated from each other by an amount slightly greater than the transverse or vertical dimension of each first portion 104A. As each hammer module 100 is propelled toward the print wheel 12, the first portion 104A thereof does not contact either of the legs 148A, 148B since the hammer module 100 at this time is moving in a predetermined plane. During return of the hammer module 100 after imprinting, a slight sideways or vertical deflection of the hammer module 100 results in the sides of the first portion 104A engaging either or both of the legs 148A, 148B. It is essential that the amount of separation between the opposing surfaces of the legs 148A and 148B be chosen so that this contact occurs before the body 102 contacts either or both of the adjoining magnet modules 122. Since the hammer head 104 is composed of a plastic material, the sideways deflection of the hammer module 100 upon return is dampened and the energy producing that sideways deflection is absorbed without damage to the hammer module 100. In addition, the contact of the first portion 104A with either or both of the legs 148A, 148B assists in dampening the planar or horizontal component of the hammer motion upon return. If desired, the U-shaped portion 148 may be cut away as illustrated in the drawings so that the alignment of the associated hammer head 104 may be visually checked.

The hammer assembly 14 is completed by a plenum 160 (FIGS. 1 and 2) which is secured to the support plate 80 by a fastener 162. Together with support plate 80, plenum 160 defines a closed chamber having an inlet 164. Cooling air is supplied to the inlet 164 by means not illustrated and exits through the slots 80A, 80B, 80C and 80E, previously described, and a vertically-extending slot 80D in support plate 80 which is located in proximity to the bodies 102 so as to cool all components of the hammer assembly 14 and in particular the coils within the bodies 102.

While the invention has been described with respect to a preferred embodiment, it is to be clearly understood by those skilled in the art that the invention is not limited thereto, but rather that the scope of the invention is intended to be interpreted only in conjunction with the appended claims.

The embodiments of the invention in which an exclusive property or privilege is claimed are defined as follows:

1. An improved hammer bank assembly for use in impact printers, said hammer bank assembly comprising:

(a) a plurality n of magnet modules, each of said plurality of magnet modules including at least one substantially flat permanent magnet;

(b) an assembly support member;

(c) first means securing said plurality of magnet modules to said assembly support member in a spaced-apart manner so that said permanent magnets are parallel to each other and define a plurality of air gaps, each said air gap being located between adjacent ones of said plurality of permanent magnets;

(d) a plurality of n−1 of hammer modules, each of said plurality of hammer modules including a substantially flat body containing an electrical coil, said body having first and second ends, a hammer head attached to said first end and coplanar with said body, said hammer head having a first portion, of substantially elongated, rectangular configuration, and a second portion integral with and tapering outwardly from said first portion, and a hammer face projecting from said second portion;

a base attached to said second end, and a pair of electrically-conductive spring members secured to and extending from said base, said pair of electrically-conductive spring members being interconnected with said electrical coil;

(e) a plurality of n−1 of hammer support members, each of said plurality of hammer support members receiving a corresponding said pair of electrically-conductive spring members of one of said plurality of hammer modules to thereby support one of said plurality of hammer modules for pivotal movement in a predetermined plane;

(f) second means securing said plurality of hammer support members to said assembly support member in a spaced-apart manner so that said bodies of said plurality of hammer modules are parallel to each other and so that said bodies are located in corresponding ones of said plurality of air gaps, whereby each of said hammer modules is free to pivot in its predetermined plane upon application of an electrical signal to said electrical coil via said pair of electrically-conductive spring members;

(g) a plurality n−1 of hammer guide members, each of said plurality of hammer guide members defining therein an elongated, substantially rectangular groove complementary to said first portion of each said hammer head; and (h) third means securing said plurality of hammer guide members to said assembly support member in a spaced-apart manner so that said first portion of said head of each of said plurality of hammer modules is received in a corresponding one of said grooves, the dimension of each said groove in a direction transverse to the predetermined plane of hammer movement being larger than a corresponding dimension of said first portion but small enough so that said first portion contacts said hammer support member upon deflection of said hammer module in directions transverse to its predetermined plane before the associated body contacts either of said adjacent ones of said plurality of permanent magnets.

2. A hammer bank assembly as recited in claim 1, wherein said assembly support member comprises a support plate; wherein said second means comprises: a plurality of bars, one for each of said plurality of hammer support members, and means for compressing said support plate between each of said plurality of hammer support members and a corresponding one of said plurality of bars.

3. A hammer bank assembly as recited in claim 2, wherein said support plate defines a plurality of spaced-apart, parallel slots therein, and wherein said means for compressing includes a plurality of fastener means, each of said plurality of fastener means passing through one of said plurality of bars, through said plurality of slots, and being received in a corresponding one of said plurality of hammer support members.

4. A hammer bank assembly as recited in claim 1, wherein said assembly support member comprises a support plate; wherein said first means comprises: a plurality of L-shaped members, one for each of said plurality of magnet modules, each of said plurality of L-shaped members having a first leg, and means for compressing said support plate between each of said magnet modules and a corresponding one of said first legs; wherein said third means comprises a second leg of n−1 ones of said plurality of each said L-shaped members, each said second leg being integral with and extending perpendicularly from its associated first leg and being offset therefrom so as to be substantially coplanar with and extending toward said head of a corresponding one of said plurality of hammer modules in assembly; and wherein each of said hammer guide means includes a first rectangular portion secured to a corresponding one of said second legs, and a second, integral portion having defined therein said groove.

5. A hammer bank assembly as recited in claim 4, further comprising a plurality of n−1 of stop means for adjustably determining rest positions for said plurality of hammer modules, each of said stop means including an aperture defined by and extending through said second leg of n−1 ones of said plurality of L-shaped members, and a stop screw received in and rotatable in said aperture and having a tip protruding from said second leg for engaging said first portion of said hammer head of a corresponding one of said plurality of hammer modules.

6. A hammer bank assembly as recited in claim 5, wherein said hammer heads and said stop screws are formed from a plastic material.

7. A hammer bank assembly as recited in claim 4, wherein said support plate defines a plurality of spaced-apart, parallel slots therein and wherein said means for compressing includes a plurality of fastener means, each of said plurality of fastener means passing through said second leg of one of said pluraity of L-shaped members, through said plurality of slots, and being received in a corresponding one of said plurality of magnet modules.

8. A hammer bank assembly as recited in claim 1, wherein said hammer heads are formed from a plastic material.

9. In a hammer bank assembly inculding a plurality of spaced-apart, parallel hammers, each of the hammers including a substantially planar, hammer body containing an electrical coil, each hammer body being supported for movement in a predetermined plane, and a hammer head attached to and coplanar with each hammer body, the hammer bank assembly further including a plurality of flat permanent magnets interleaved with the plurality of hammers so that adjacent ones of the permanent magnets oppose but are separated from each hammer body, whereby each of the hammers is caused to move in its predetermined plane upon application of an electrical signal to the electrical coil within the corresponding hammer body and a resultant magnetic interaction with the adjacent permanent magnets, the improvement comprising hammer guide means for preventing damage to the electrical coils, said hammer guide means having a pair of opposing, spaced-apart surfaces associated with each hammer, said pair of surfaces being located in proximity to each hammer head and being positioned so that the hammer head contacts one of said pair of surfaces before the attached hammer body contacts either of the adjacent permanent magnets upon deflection of the hammer in directions transverse to the predetermined plane of hammer movement.

10. The improvement as recited in claim 9, wherein each said pair of surfaces includes first and second, opposing, longitudinally-extending surfaces which lie in planes parallel to but separated from the predetermined plane of hammer movement, and wherein each of the hammer heads is provided with a substantially rectangular, elongated portion for contacting either of said first and said second surfaces upon deflection of the hammer.

* * * * *